US008418805B1

(12) United States Patent
Han

(10) Patent No.: US 8,418,805 B1
(45) Date of Patent: Apr. 16, 2013

(54) MUFFLER FOR VEHICLE

(75) Inventor: Hak Son Han, Seongnam-si (KR)

(73) Assignee: Hyundai Motor Company, Seoul (KR)

( * ) Notice: Subject to any disclaimer, the term of this patent is extended or adjusted under 35 U.S.C. 154(b) by 0 days.

(21) Appl. No.: 13/492,581

(22) Filed: Jun. 8, 2012

(51) Int. Cl.
*F01N 1/08* (2006.01)

(52) U.S. Cl.
USPC ..... 181/264; 181/246; 181/272; 181/212

(58) Field of Classification Search ..... 181/212, 181/246, 264, 272
See application file for complete search history.

(56) References Cited

U.S. PATENT DOCUMENTS 4,993,513 A * 2/1991 Inoue et al. ..... 181/282
5,468,923 A * 11/1995 Kleyn ..... 181/282
5,936,210 A * 8/1999 Borneby et al. ..... 181/264
5,979,598 A * 11/1999 Wolf et al. ..... 181/272
6,089,347 A * 7/2000 Flugger ..... 181/264
6,913,112 B2 * 7/2005 Bogard ..... 181/252
7,464,789 B2 * 12/2008 Yamamoto et al. ..... 181/256
7,810,609 B2 * 10/2010 Sikes et al. ..... 181/250
7,942,237 B2 * 5/2011 van de Flier et al. ..... 181/256
7,971,682 B2 * 7/2011 Inoue et al. ..... 181/269
2005/0258001 A1 * 11/2005 Ryczek et al. ..... 181/272
2006/0266580 A1 * 11/2006 Seiler ..... 181/268
2008/0066998 A1 * 3/2008 Hara ..... 181/212
2009/0145689 A1 * 6/2009 Han ..... 181/272
2010/0126799 A1 * 5/2010 Matsueda et al. ..... 181/271

* cited by examiner

*Primary Examiner* — Forrest M Phillips
(74) *Attorney, Agent, or Firm* — Morgan, Lewis & Bockius LLP

(57) ABSTRACT

A muffler for a vehicle includes an inner casing, the inner space of the inner casing is divided by baffles to form a plurality of chambers, the inner casing having an entrance defined in one end and an exit defined in the other end, the entrance and the exit communicating with each other. An insulator surrounds the contour of the inner casing. An outer casing surrounds the contour of the insulator, the outer casing being made of synthetic resin.

7 Claims, 3 Drawing Sheets

MUFFLER FOR VEHICLE

CROSS-REFERENCE TO RELATED APPLICATIONS

The present application claims priority of Korean Patent Application Number 10-2011-0130843 filed Dec. 8, 2011, the entire contents of which application is incorporated herein for all purposes by this reference.

BACKGROUND OF INVENTION

1. Field of Invention

The present invention relates, in general, to a muffler for a vehicle, in which the structure, size and material thereof have been modified so that the muffler is light in weight and sound radiation and the sound of the exhaust are reduced.

2. Description of Related Art

Generally, a gas exhaust system for discharging exhaust gas from a vehicle is provided with a muffler that can reduce the noise produced by the exhaust gas.

That is, the muffler serves to reduce noise from the exhaust gas makes as it is discharged from an engine by decreasing the temperature and pressure of the exhaust gas. Mufflers are classified into several types depending on the structure. Among the several types, a baffle type muffler is configured such that the inner space thereof is divided into several chambers by baffles.

Accordingly, the noise from the exhaust gas is gradually reduced while it passes through the chamber, for example, by the interference of acoustic waves, reduction in the pressure variations, and a decrease in the temperature of the exhaust gas.

FIG. 1 shows the structure of a muffler of the related art. In this muffler, an upper case 1 has two layers, a lower case 2 has two layers, and the rims of the upper case 1 are connected to the rims of the lower case 2 by pressing and clinching the upper and lower cases 1 and 2 (so that the rims are rolled).

However, since the structural characteristics of the muffler of the related art are such that the upper case and the lower case are made of two layers of steel material, there are problems in that the muffler is inefficient in reducing radiated sound and that the weight of the muffler increases.

The information disclosed in this Background section is only for enhancement of understanding of the general background of the invention and should not be taken as an acknowledgement or any form of suggestion that this information forms the prior art already known to a person skilled in the art.

SUMMARY OF INVENTION

Accordingly, the present invention has been made keeping in mind the above problems occurring in the related art, and the present invention proposes a muffler for a vehicle, which is light in weight because of modifications in its structure, size and material, and which is designed to reduce the radiated sound and the sound of exhaust Various aspects of the present invention provide for a muffler for a vehicle that includes an inner casing, the inner space of the inner casing is divided by baffles to form a plurality of chambers, the inner casing having an entrance defined in one end and an exit defined in the other end, the entrance and the exit communicating with each other, an insulator surrounding the contour of the inner casing, and an outer casing surrounding the contour of the insulator, the outer casing being made of synthetic resin.

In various embodiments, the inner casing may include a plurality of covers that are assembled together, portions of the covers that abut against each other are fixed to each other by welding In various embodiments, the inner casing may include an upper cover provided on the upper front portion thereof, a lower cover fixed to the lower portion of the upper cover, the shape of the upper rim of the lower cover being the same as that of the lower rim of the upper cover, a middle cover fixed to a respective rear end portion of the upper cover and the lower cover, the shape of the front rim of the middle cover being the same as that of the respective rear rim of the upper cover and the lower cover, and an end cover fixed to the rear end of the middle cover, the shape of the front rim of the end cover being the same as that of the rear rim of the middle cover.

In various embodiments, the inner casing may include a plurality of baffles configured such that the baffles are inserted into the inner circumference of the inner casing such that a plurality of chambers is formed inside the inner casing, a first pipe, one end of which is positioned at the entrance of the inner casing, the first pipe extending through the baffles such that the other end thereof communicates with a rearmost one of the chambers, a second pipe configured such that the second pipe extends through the baffles, wherein one end of the second pipe communicates with a forwardmost one of the chambers and the other end of the second pipe communicates with the rearmost chamber, and a third pipe having one end formed at the exit of the inner casing, the third pipe extending through the baffles such that the other end thereof communicates with the forwardmost chamber.

In various embodiments, the muffler may further include an acoustic absorbent disposed inside a middle one of the chambers that is defined between the baffles.

In various embodiments, the diameter of the second pipe may be smaller than that of the first pipe and that of the third pipe.

In various embodiments, the first pipe, the second pipe and the third pipe may have first gas-holes formed in portions thereof that are inside of a middle one of the chambers between the baffles, such that exhaust gas that flows inside the pipes is discharged through the first gas-holes into the middle chamber.

In various embodiments, the baffles may have second gas-holes through which the exhaust gas passes between the chambers.

In various embodiments, the first pipe may have a third gas-hole in a portion thereof that is in a forwardmost one of the chambers, such that exhaust gas that flows inside the first pipe is discharged through the third gas-hole into the forwardmost chamber.

According to various embodiments of the invention, the muffler may have a triple structure including the outer casing, the insulator and the inner casing in order to enhance the noise reduction performance, thereby significantly reducing radiated sound and exhaust sound produced by the exhaust gas.

Furthermore, the outer casing may be made of synthetic resin, while the volume of the muffler is greatly reduced without decreasing the noise reduction performance. This can consequently reduce the weight of the muffler, thereby increasing the fuel efficiency of the vehicle.

In addition, noise is reduced since the exhaust gas that is introduced into the muffler may be dispersed while it passes through the first pipe, the second pipe and the third pipe. Additional dispersion may also realized through the first, the second and the third gas-holes, thereby further enhancing the noise reduction performance. Furthermore, the acoustic absorbent that is provided inside the second chamber can further enhance the performance reducing the noise from the exhaust gas that passes through the muffler.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Figure 1:
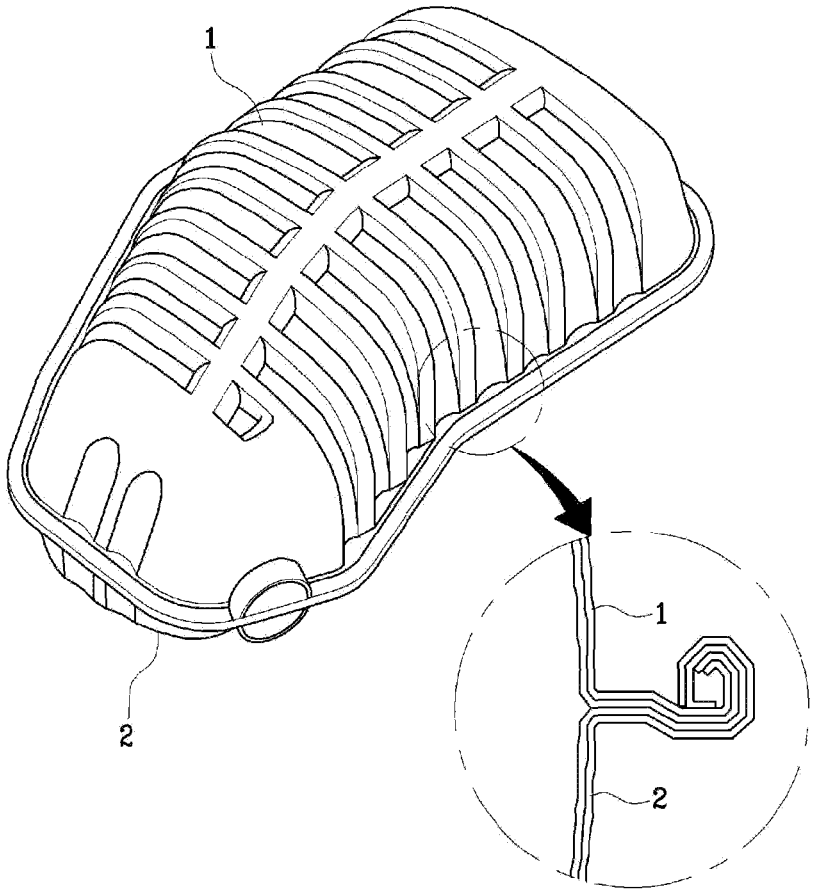
FIG. 1 (Related Art)
FIG. 1 is a view showing the configuration of a muffler for a vehicle of the related art.
Figure 2:
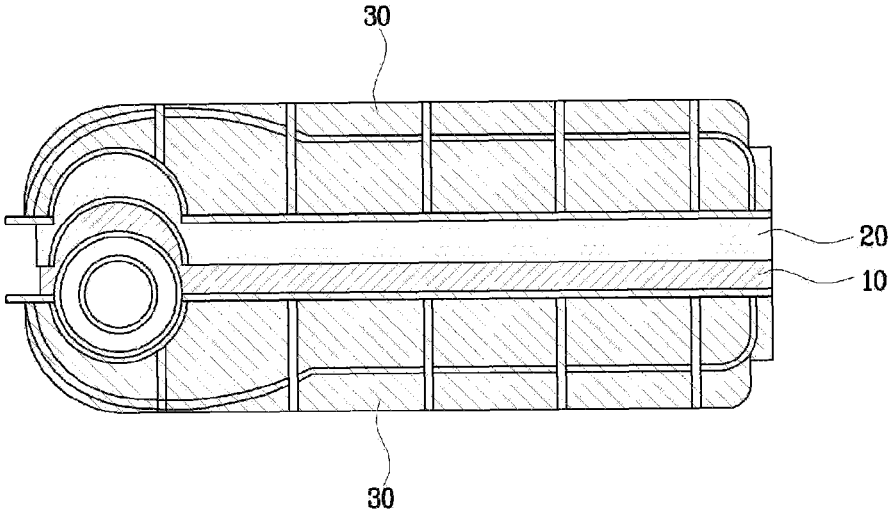
FIG. 2 is a view showing the triple structure of an exemplary muffler for a vehicle according to the present invention.
Figure 3:
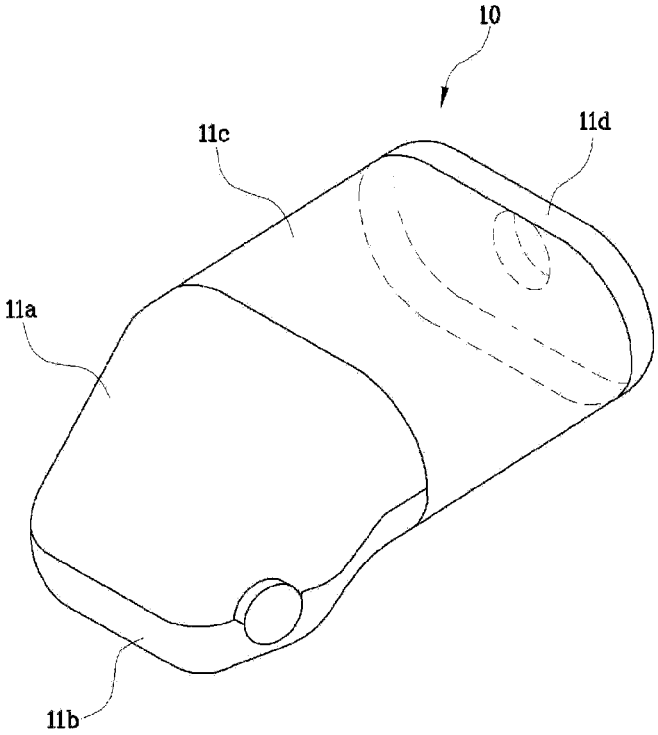
FIG. 3 is a view showing the structure of the inner casing of an exemplary muffler for a vehicle according to the invention.

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

Referring to FIG. 2 to FIG. 5, a muffler for a vehicle according to various embodiments of the invention includes an inner casing 10, the inner space of which is divided into a plurality of chambers 13 by baffles 12, and which has an entrance in one end and an exit in the other end, the entrance and the exit communicating with each other, an insulator 20 surrounding the contour of the inner casing, and an outer casing 30 surrounding the contour of the insulator 20, the outer casing being made of synthetic resin.

The insulator 20 is wound on the outer surface of the inner casing 10, which is composed of one layer, and the outer casing 30, which is composed of one layer, is wound on the outer surface of the insulator 20. Consequently, the structure of the muffler is a triple structure, and thus is extremely effective at reducing both radiated sound and sound from exhaust gas.

In particular, the outer casing 30 is made of synthetic resin, thereby making it possible to reduce the weight of the muffler to increase fuel efficiency. This also improves the corrosion resistance and abrasion resistance characteristics of the outer surface of the muffler, thereby improving the quality of the muffler.

The volume of the muffler of various embodiments may be about 17L, whereas the volume of the muffler of the related art is about 21L. It is, therefore, apparent that the weight of the muffler can be significantly reduced.

In the inner casing 10, the portions of a plurality of covers that are in contact with can be fixed to each other by welding.

In various embodiments, the inner casing 10 may include an upper cover 11*a* provided on the upper front portion thereof, a lower cover 11*b* fixed to the lower portion of the upper cover 11*a*, the upper rim of the lower cover 11*b* being shaped the same as the lower rim of the upper cover 11*a*, a middle cover 11*c* fixed to the respective rear end portion of the upper cover 11*a* and the lower cover 11*b*, the shape of the front rim of the middle cover 11*b* being the same as the respective rear rim of the upper cover 11*a* and the lower cover 11*b*, and an end cover 11*d* fixed to the rear end of the middle cover 11*c*, the shape of the front rim of the end cover 11*d* being the same as the rear rim of the middle cover 11*c*.

Since the rims where the upper cover 11*a*, the lower cover 11*b*, the middle cover 11*c* and the end cover 11*d* abut against each other are bonded by welding, such as tungsten inert gas (TIG) welding, the inner casing 10 is not provided with a flange at the outer portion thereof, unlike the related art. Consequently, the insulator 20 and the outer casing 30 can be provided on the outer surface of the inner casing 10 such that they surround the inner casing 10, thereby achieving an excellent reduction in sound radiation and the sound of the exhaust produced by the muffler.

In various embodiments, the inner casing 10 may include a plurality of baffles 12, a first pipe 15, a second pipe 16 and a third pipe 17. The baffles 12 are configured so as to be inserted into the inner circumference of the inner casing 10 such that a plurality of chambers 13 is formed inside the inner casing 10. The first pipe 15 has one end formed at the entrance of the inner casing 10, and extends through the baffles 12 such that the other end thereof communicates with the rearmost chamber 13. The second pipe 16 is configured such that it extends through the baffles 12, with one end thereof communicating with the forwardmost chamber 13 and the other end thereof communicating with the rearmost chamber 13. The third pipe 17 has one end formed at the exit of the inner casing 10, and extends through the baffles 12 such that the other end thereof communicates with the forwardmost chamber 13.

Here, the baffles 12 may be composed of a first baffle 12*a* and a second baffle 12*b*, which divide the chamber 13 into a forwardmost first chamber 13*a*, a second chamber 13*b* next to the first chamber 13*a*, and a rearmost third chamber 13*c* next to the second chamber 13*b*. The number of baffles 12 and the number of chambers 13 may be set to be more or less depending on the structure of the muffler, such that the structure can be variously modified.

Specifically, exhaust gas that is introduced through the first pipe 15 is discharged through the rearmost third chamber 13*c*, the exhaust gas that has been discharged through the third chamber 13*c* is discharged to the forwardmost first chamber 13*a* through the second pipe 16, and the exhaust that has been discharged to the first chamber 13*a* is discharged to the outside of the muffler through the third pipe 17.

In the present invention, the inside of the middle chamber 13*b* that is defined the baffles 12 may be filled with an acoustic absorbent 14.

As for the acoustic absorbent 14, when the exhaust gas that has been introduced into the muffler through the first pipe 15 is discharged to the outside of the muffler by passing through the second chamber 13*b* that is defined between the first and second baffles 12*a* and 12*b*, the acoustic absorbent 14 reduces the high-frequency acoustic component of the exhaust gas while the exhaust gas is passing through the first pipe 15 to the third pipe 17, thereby efficiently reducing the radiated sound and the exhaust sound of the exhaust gas.

In the present invention, the diameter of the second pipe 16 may be smaller than that of the first pipe 15 and that of the third pipe 17.

By means of example, when the diameter of the first pipe 15 or the second pipe 17 is about 50 mm, the diameter of the second pipe 16 is set to be smaller than 50 mm.

As the diameter of the second pipe 16 is set to be small, the exhaust gas is dispersed when it is discharged from the narrower second pipe 16 to the relatively wider first chamber 13*a*, thereby reducing the noise of the exhaust gas.

In the present invention, a number of first gas-holes h1 having a small diameter is formed in the first pipe 15, the second pipe 16 and the third pipe 17, so that the exhaust gas that is flowing through the pipes can be discharged into the chamber 13. The first gas-holes h1 can be formed in the portions of the pipes that are inside the middle chamber 13*b* between the baffles 12.

Specifically, the exhaust gas that is passing through the first pipe 15, the second pipe 16 and the third pipe 17 is dispersed by being discharged from the narrow first gas-holes h1 into the relatively wider second chamber 13, thereby attenuating or nullifying the noise of the exhaust gas.

In the present invention, the baffles 12 may be provided with second gas-holes h2 through which exhaust gas can pass between the respective chambers 13.

Specifically, the exhaust gas that has been dispersed inside the second chamber 13*b* is dispersed by being discharged from the second gas-holes h2 that have a small diameter into the first chamber 13*a* and the third chamber 13*c* that are relatively wider spaces, thereby attenuating or nullifying the noise of the exhaust gas.

In the present invention, the first pipe 15 is provided with a third gas-hole h3 through which exhaust gas that is flowing inside the first pipe 15 is discharged into the chamber 13. Particularly, the third gas-hole h3 may be formed in the portion of the first pipe 15 that is inside the forwardmost chamber 13.

Specifically, the exhaust gas that is passing through the first pipe 15 is dispersed by being discharged from the third gas-hole h3 that has a small diameter into the first chamber 13*a* that is a relatively wider space, thereby attenuating or nullifying the noise of the exhaust gas.

Figure 4:
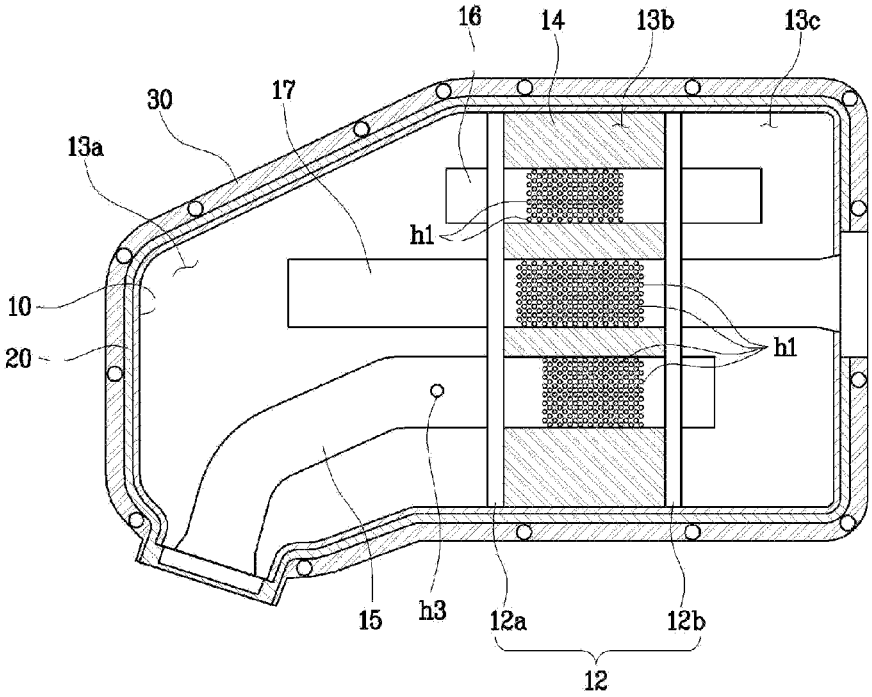
FIG. 4 is a view showing the inner structure of an exemplary muffler for a vehicle according to the present invention.
Figure 5:
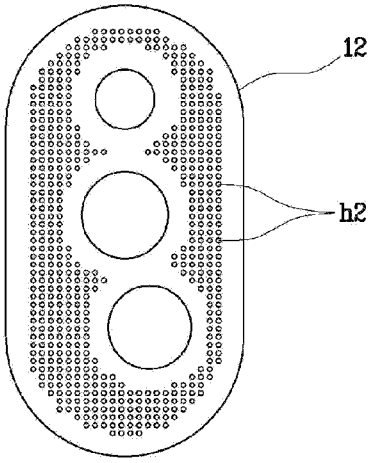
FIG. 5 is a view showing the shape of the baffle of an exemplary muffler for a vehicle according to the present invention.

The operation and effect of the present invention are described in detail with reference to FIG. 4 and FIG. 5.

Describing the flow of exhaust gas through the muffler according to various embodiments of the invention, when the exhaust gas is introduced through the first pipe 15, a considerable portion of the exhaust gas is introduced into the third chamber 13*c*, another portion of the exhaust gas is introduced into the third pipe 17 by being discharged and dispersed through third gas-holes h3, and a third portion of the exhaust gas is discharged and dispersed into the second chamber 13*b* through the first gas-holes h1.

In sequence, a considerable portion of the exhaust gas that has been introduced into the third chamber 13*c* is introduced into the first chamber 13*a* through the second pipe 16 and then into the third pipe 17, and another portion of the same exhaust gas is discharged and dispersed into the second chamber 13*b* through the first gas-holes h1.

In addition, a considerable amount of the exhaust gas that has been introduced into the third pipe 17 is discharged to the outside of the vehicle. In this process, a portion of the exhaust gas is discharged and dispersed into the second chamber 13*b* through the first gas-holes h1.

Furthermore, the exhaust gas that is dispersed into the second chamber 13*b* through the first gas-holes h1 is dispersed into the first chamber 13*a* and the third chamber 13*c* through the second gas-holes h2 formed in the baffles 12, thereby creating the above-described flow of gas.

As described above, since the exhaust gas that is introduced into the muffler is dispersed while it is passing through the first pipe 15, the second pipe 16 and the third pipe 17, the noise is reduced. Since the exhaust gas is additionally dispersed through the first gas-holes h1, the second gas-holes h2 and the third gas-holes h3, the noise reduction performance can be enhanced.

In addition, in the present invention, the acoustic absorbent 14 that is provided inside the second chamber 13*b* can further enhance the noise reduction performance for the noise of the exhaust gas that passes through the muffler.

In particular, in the present invention, the structure of the muffler is a triple structure including the outer casing 30, the insulator 20 and the inner casing 10 and so can achieve more improved noise reduction performance, thereby significantly reducing the radiated sound and exhaust sound of the muffler.

Furthermore, in the present invention, the outer casing 30 is made of synthetic resin, and the volume of the muffler is significantly reduced without decreasing the ability to reduce noise, thereby decreasing the weight of the muffler and thus increasing the fuel efficiency of the vehicle.

For convenience in explanation and accurate definition in the appended claims, the terms upper or lower, front or rear, inside or outside, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A muffler for a vehicle comprising:

an inner casing, wherein an inner space of the inner casing is divided by a plurality of baffles to form a plurality of chambers, the inner casing having an entrance defined in one end and an exit defined in the other end, the entrance and the exit communicating with each other; an insulator surrounding a contour of the inner casing; and an outer casing surrounding a contour of the insulator, the outer casing being made of synthetic resin, wherein the inner casing comprises a plurality of covers that are assembled together, portions of the covers that abut against each other are fixed to each other by welding, wherein the inner casing comprises:

an upper cover provided on an upper front portion thereof, a lower cover fixed to a lower portion of the upper cover, an upper rim of the lower cover having a shape that is the same as that of the lower rim of the upper cover; a middle cover fixed to a respective rear end portion of the upper cover and the lower cover, a front rim of the middle cover having a shape that is the same as that of a respective rear rim of the upper cover and the lower cover; and an end over fixed to a rear end of the middle cover, a front rim of the end cover a shape that is the same as that of a rear rim of the middle cover.

2. The muffler for a vehicle of claim 1, wherein the inner casing comprises:

a plurality of baffles inserted into an inner circumference of the inner casing such that a plurality of chambers is formed inside the inner casing;

a first pipe, one end of which is positioned at the entrance of the inner casing, the first pipe extending through the plurality of baffles such that the other end thereof communicates with a rearmost one of the chambers;

a second pipe configured such that the second pipe extends through the plurality of baffles, wherein one end of the second pipe communicates with a forwardmost one of the chambers and the other end of the second pipe communicates with the rearmost chamber; and a third pipe having one end formed at the exit of the inner casing, the third pipe extending through the plurality of baffles such that the other end thereof communicates with the forwardmost chamber.

3. The muffler for a vehicle of claim 2, further comprising an acoustic absorbent disposed inside a middle one of the chambers that is defined between the plurality of baffles.

4. The muffler for a vehicle of claim 2, wherein the diameter of the second pipe is smaller than that of the first pipe and that of the third pipe.

5. The muffler for a vehicle of claim 2, wherein the first pipe, the second pipe and the third pipe have first gas-holes formed in portions thereof that are inside of a middle one of the chambers between the plurality of baffles, such that exhaust gas that flows inside the pipes is discharged through the first gas-holes into the middle chamber.

6. The muffler for a vehicle of claim 5, wherein the plurality of baffles have second gas-holes through which the exhaust gas passes between the chambers.

7. The muffler for a vehicle of claim 2, wherein the first pipe has a third gas-hole in a portion thereof that is in a forwardmost one of the chambers, such that exhaust gas that flows inside the first pipe is discharged through the third gas-hole into the forwardmost chamber.

* * * * *